United States Patent [19]

Degeneff et al.

[11] 4,317,096

[45] Feb. 23, 1982

[54] ELECTROSTATIC SHIELDING OF NONSEQUENTIAL DISC WINDINGS IN TRANSFORMERS

[75] Inventors: Robert C. Degeneff, Pittsfield, Mass.; John C. Crouse, Rome, Ga.

[73] Assignee: General Electric Company

[21] Appl. No.: 166,524

[22] Filed: Jul. 7, 1980

Related U.S. Application Data

[62] Division of Ser. No. 30,157, Apr. 16, 1979, Pat. No. 4,243,966.

[51] Int. Cl.[3] ..... H01F 15/14

[52] U.S. Cl. ..... 336/70; 336/84 C

[58] Field of Search ..... 336/69, 70, 84 R, 84 C, 336/186, 187

[56] References Cited

U.S. PATENT DOCUMENTS

| | | | |
|---|---|---|---|
| 2,905,911 | 9/1959 | Korita | 336/70 |
| 3,380,007 | 4/1968 | Alverson et al. | 336/70 |
| 3,691,494 | 9/1972 | Ikuyama | 336/70 |
| 3,748,617 | 7/1973 | Crouse | 336/70 |
| 4,042,900 | 8/1977 | Hinton et al. | 336/70 |

FOREIGN PATENT DOCUMENTS

| | | | |
|---|---|---|---|
| 964736 | 3/1975 | Canada | 336/70 |
| 1147282 | 11/1957 | France | 336/187 |

*Primary Examiner*—Thomas J. Kozma
*Attorney, Agent, or Firm*—Robert A. Cahill

[57] ABSTRACT

Transformer coils wound with disk winding sections nonsequentially arranged are provided with shields between the turns of mechanically adjacent sections to increase the series capacitance of the winding. The increased series capacitance of the winding allows a reduction in insulation between the individual winding turns and between the winding discs.

2 Claims, 8 Drawing Figures

ELECTROSTATIC SHIELDING OF NONSEQUENTIAL DISC WINDINGS IN TRANSFORMERS

This is a division of application Ser. No. 30,157, now U.S. Pat. No. 4,243,966, filed Apr. 16, 1979.

BACKGROUND OF THE INVENTION

The initial impulse distribution of a transformer winding grounded at one end is given by the well known relation $V=V_0 \sinh a(1-X)/\sinh a$, where $X$=percent distance along the winding from the line end, $a=(C_g/C_s)^{\frac{1}{2}}$ where $C_g$=the total capacitance between the winding and ground and $C_s$=the total series capacitance of the winding.

The initial impulse distribution along the winding provides a voltage stress at the impulsed end of the coil greater than the stress caused by the steady state voltage distribution within the winding. The ratio of the impulse voltage stress to the operating voltage stress is equal to a. The impulse (initial) stress can be reduced by increasing $C_s$ causing a to decrease. The effective series capacitance in a disc wound transformer winding is composed of the turn-to-turn capacitance between the electrical conductors making up the winding and the section-to-section capacitance between the sections along the disc winding. Various attempts have been employed to increase the effect of both the turn-to-turn and section-to-section capacitance of the winding upon the effective series capacitance of a disk winding section. One method for increasing the use of the turn to turn capacitance consists in the employment of electrostatic shields between the turn conductors. U.S. Pat. Nos. 3,691,494 and 4,042,900 teach various configurations of inter section electrostatic shields for increasing the series capacitance in disk windings. The aforementioned U.S. patents teach the insertion of shields in disk winding arrangements that are continuously connected in mechanical and electrical series. A second method of configuring disk winding sections makes more effective use of the section-to-section capacitance is taught in French Pat. No. 1,147,282. This patent shows that an increase in series capacitance can be achieved by connecting the sections nonsequentially. A third method which maximizes the use of the turn-to-turn series capacitance in the winding is to interlace the turns so that the electrically sequential turns are not physically adjacent.

The purpose of this invention is to provide an electrostatic shielding arrangement for nonsequential disk windings wherein the effective series capacitance of the winding is the highest heretofore obtained in a disk winding configuration.

GENERAL DESCRIPTION OF THE INVENTION

Figure 1:
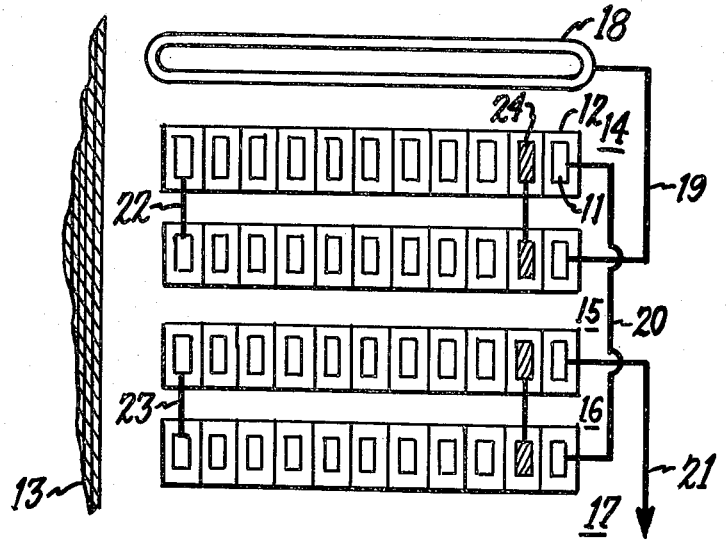
FIG. 1 is a side sectional view of a shielded nonsequential winding arrangement with shields along the outside of the winding according to the invention.

The series capacitance of a disc winding section pair wound as a continuous disk is given by the expression $$C_1 = C_x\left(\frac{n}{6} + \left(\frac{n-2}{n^2}\right) a_k\right)$$

where n=the number of turns in the section pair, $C_x$=the capacitance from a single turn to the equal potential plane above or below the section, $a_k$=the ratio of $C_w$ to $C_x$ where $C_w$ is the capacitance between turns of a section. The increased series capacitance of a disk winding section pair connected as nonsequential discs is given by the relationship $$C_2 = C_x\left(\frac{n}{3} + \left(\frac{n-2}{n^2}\right) a_k\right)$$

The series capacitance of disk winding section pairs connected as continuous disks and containing internal shields as taught by the aforementioned U.S. patents is given by the expression $$C_2 = C_x\left(\frac{n}{6} + 0.8a_k\left(\frac{n^2-3n+1}{n^2}\right)\right)$$

for a section pair with each section containing a single shield.

The series capacitance of a section pair with each section containing two shields is given by the expression $$C_4 = C_x\left(\frac{n}{6} + 0.8a_k\left(\frac{2n^2-11n+16}{n^2}\right)\right)$$

and the series capacitance of a sectioned pair with each section containing three shields is given by the expression $$C_5 = C_x\left(\frac{n}{6} + .8a_k\left(\frac{3n^2-22n+44.5}{n^2}\right)\right)$$

The series capacitance of a section connected as an interlaced disk winding is given by $$C_6 = C_x\left(.2818n + \left(\frac{n-4}{4}\right) a_k\right).$$

It can be seen from the above expressions ($C_3$–$C_5$) that as the number of shields within each section are increased the effective series capacitance of a continuous disk containing shields also increases. It can also be seen that the connection of a disk section as an interlaced disc winding provides a series capacitance ($C_6$) greater than the series capacitance connection ($C_5$) including as many as three shields. In order to determine quantitative values for the various winding configurations, examples one and two are given having the dimensions listed in Table I.

The calculated series capacitance for the aforementioned examples are given in TABLE II and it can be seen that the interlaced winding series capacitance ($C_6$) is substantially higher for both examples than either the section pair connected as a nonsequential disc ($C_2$) or with the inclusion of internal shields within a continuous disk winding arrangement ($C_3$ to $C_5$). The use of the interlaced winding configuration is limited by the difficulties involved in winding large cross section conductors into the interlaced configuration.

TABLE I

| | | Example 1 | Example 2 |
|---|---|---|---|
| $R_{av}$ | = average radius to center line of section | 21.34" | 35.00" |
| n | = number of turns in section pair | 42 | 30 |
| w | = radial build of conductor | .115" | .125" |
| $t_I$ | = turn insulation (both sides) | .072" | .144" |
| $h_c$ | = axial height of conductor | .440" | .350" |
| d | = axial duct dimension | .225" | .225" |
| $R_b$ | = radial build of section | 3.927" | 4.035" |
| $C_w$ | = turn to turn capacitance | $5.71 \times 10^{-10}$f | $3.73 \times 10^{-10}$f |
| $C_x$ | = turn to epp capacitance | $9.57 \times 10^{-11}$f | $1.89 \times 10^{-10}$f |
| $a_k$ | = $C_w/C_x$ | 5.96 | 1.97 |

TABLE II

| Series Capacitance | Example 1 | Example 2 |
|---|---|---|
| $C_1$ | 7.14 $C_x$ | 5.06 $C_x$ |
| $C_2$ | 14.14 $C_x$ | 10.06 $C_x$ |
| $C_3$ | 11.43 $C_x$ | 6.44 $C_x$ |
| $C_4$ | 15.33 $C_x$ | 7.64 $C_x$ |
| $C_5$ | 18.93 $C_x$ | 8.71 $C_x$ |
| $C_6$ | 68.46 $C_x$ | 21.45 $C_x$ |
| $C_7$ | 18.43 $C_x$ | 13.04 $C_x$ |
| $C_8$ | 31.84 $C_x$ | 15.83 $C_x$ |
| $C_9$ | 40.06 $C_x$ | 18.42 $C_x$ |

DESCRIPTION OF THE PREFERRED EMBODIMENT

Increased series capacitance, attained by including a plurality of electrostatic shields within transformer disk windings arranged in a nonsequential connection and containing a single shield as shown in FIG. 1, follows the expression:

$$C_7 = C_x\left(\frac{n}{3} + .8a_k\left(\frac{n^2 - 3_n + 1}{n^2}\right)\right)$$

The series capacitance of a section pair connected in a nonsequential arrangement and containing two shields per section is given by the expression:

$$C_8 = C_x\left(\frac{n}{3} + .8a_k\left(\frac{3n^2 - 22n + 44.5}{n^2}\right)\right)$$

Quantitative values for the aforementioned nonsequential winding sections containing three shields in one of the sections is given by the expression:

$$C_9 = C_x\left(\frac{n}{3} + .8a_k\left(\frac{3n^2 - 22_n + 44.5}{n^2}\right)\right)$$

Quantitative values for the aforementioned nonsequential winding sections containing from one to three shields for the examples I and II of TABLE I are given in TABLE II. It can be seen by comparison that the combination of electrostatic shields within nonsequential disc winding sections provides a series capacitance in excess of series connected disk winding section having an equivalent number of electrostatic shields.

The nonsequential winding arrangement of the invention with one pair of electrostatic shields is shown in FIG. 1 wherein the winding 10 consisting of a plurality of turns of a conductor 11 containing an insulating coating 12 is radially arranged around a winding form 13 in at least a first section 14 second section 15, third 16 and a fourth section 17. Although four sections are shown in the disk winding configuration depicted in FIG. 1 this is for purposes of example only since any number of sections can be employed depending upon the transformer design. The sections are interconnected in a nonsequential winding arrangement wherein an electrostatic ring shield 18 is electrically connected by means of conductor 19 to the second section and the first section is connected to the fourth section by means of electrical conductor 20. To complete the nonsequential arrangement the first section is electrically connected to the second section by means of conductor 22 and the third section is electrically connected to the fourth section by connector conductor 23. An electrostatic shield 24 in the first section is electrically connected to a corresponding electrostatic shield 24 in the second section by means of conductor 25. An electrostatic shield 24 in the third section is electrically connected by means of conductor 26 to a corresponding electrostatic shield 24 located in the fourth section. The arrangement of electrostatic shields 24 in the winding 10 of FIG. 1 is such that the shields are located between the outermost conductors of the section, that is, at the end of the section furthest from the winding form 13. Electrical connection with the winding is made by means of electrical conductor 21. The series capacitance value for this single shield configuration is given by the mathematical expression for $C_7$ given earlier for the examples listed in Table I and has the calculated capacitance values listed in Table II.

Figure 2:
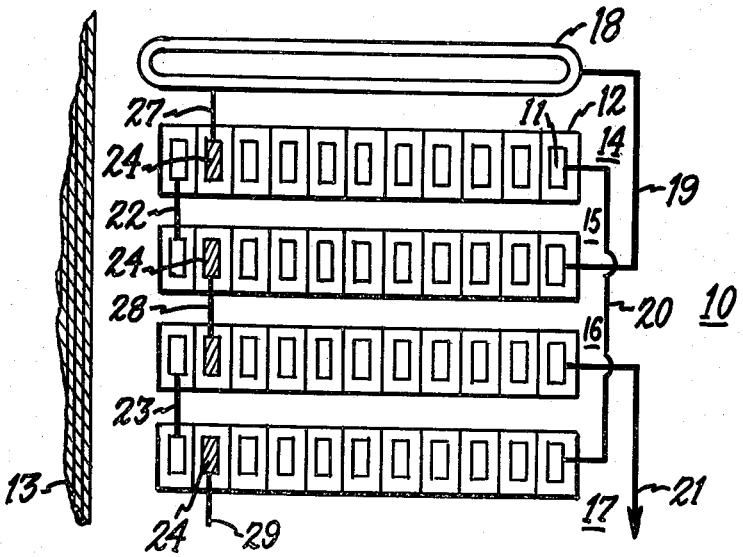
FIG. 2 is a side sectional view of a shielded nonsequential coil arrangement according to the invention with shields along the inside of the winding.

A further embodiment of a nonsequential disk winding containing electrostatic shields is shown in FIG. 2 wherein the sections 14, 15, 16 and 17 are radially arranged around winding form 13 in the same manner as described for the embodiment of FIG. 1 so that like reference numerals will be employed to designate similar elements. In the embodiment now depicted, an electrostatic shield 24 is located in the first section between the two most inner turns or strands, that is, the end of the section closest to the winding form. The shield in the first section is electrically connected to the electrostatic ring shield 18 by means of electrical conductor 27. A pair of shields is inserted within the inner end of the second and third sections and are electrically interconnected by means of electrical conductor 28. The effective series capacitance of the configuration depicted in FIG. 2, where the electrostatic shields are located at the inner end of the winding sections is given also by the expression for $C_7$. The values for the parameters of examples 1 and 2 in Table I result in the calculated capacitances given in Table II.

Figure 3:
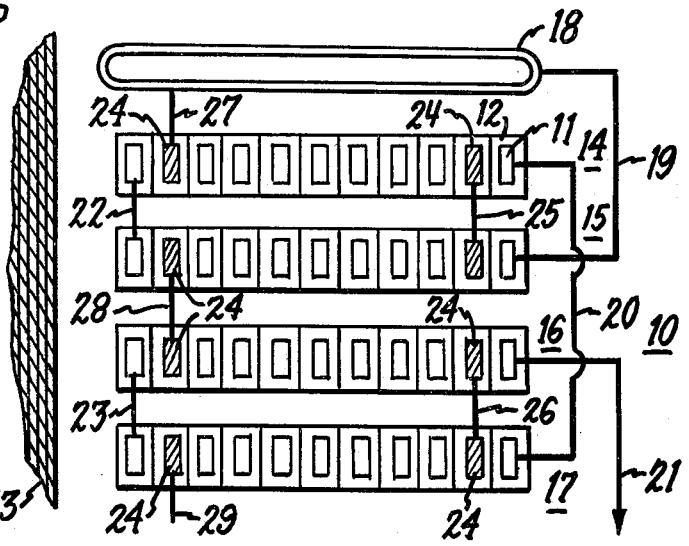
FIG. 3 is a side sectional view of a shielded nonsequential winding according to the invention with shields along both the inside and outside of the winding.

FIG. 3 contains an embodiment of the nonsequential winding arrangement 10 wherein a pair of electrostatic shields 24 are employed in each winding section and wherein one shield is situated in the outer end of the section and one shield is situated in the inner end of the section. The embodiment of FIG. 3 is similar to the earlier embodiments of FIGS. 1 and 2 and similar reference numbers will be used to depict similar elements. The series capacitance of the two shield relationship is slightly larger than that given by the expression for $C_8$.

Figure 4:
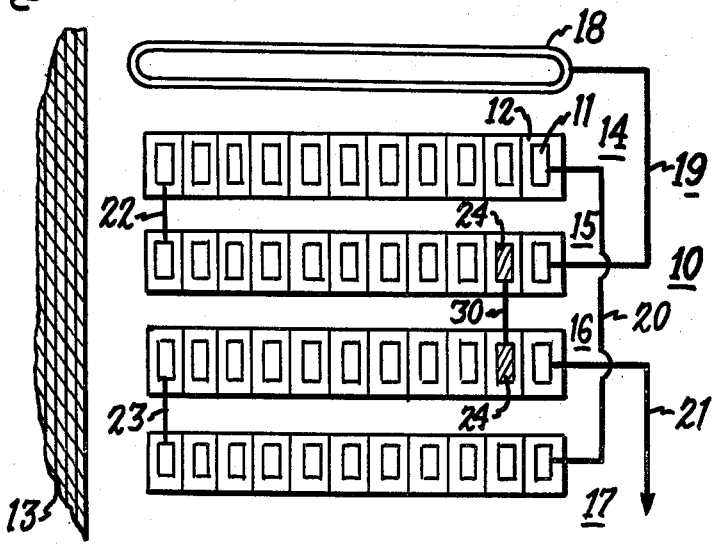
FIG. 4 is a side sectional view of an alternative arrangement of the embodiment of FIG. 1.

A simplified nonsequential winding arrangement according to the invention employing a single pair of shields is shown in FIG. 4 wherein the nonsequential winding 10 contains a shield 24 in the second section and a shield 24 in the third section electrically connected together by means of conductor 30. The effective series capacitance value for this arrangement is given by the following expression:

$$C_{10} = C_x\left(\frac{n}{3} + .8a_k\left(\frac{2n^2 - 3n - .5}{n^2}\right)\right)$$

Figure 5:
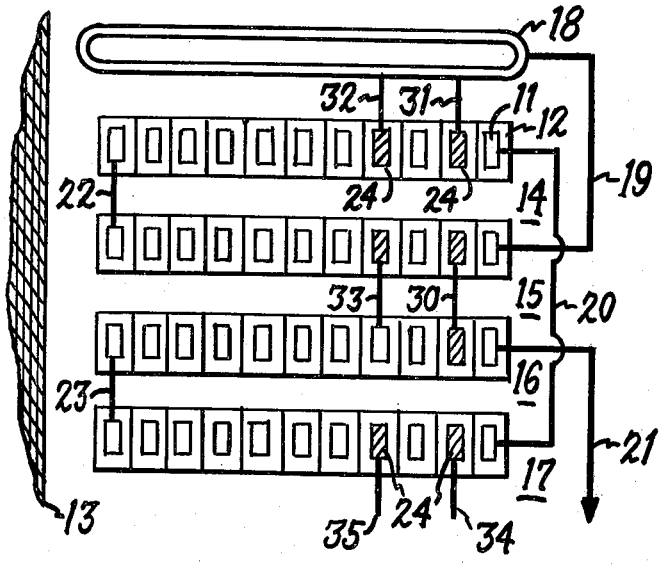
FIG. 5 is a side sectional view of an alternative arrangement of the embodiment of FIG. 4.

FIG. 5 contains an embodiment wherein a pair of shields 24 are contained in the outer end of each coil section. One shield 24 in the first section is electrically connected to electrostatic ring shield 18 by means of electrical conductor 31 and the other shield 24 in the first section is connected to electrostatic ring shield 18 by electrical connector 32. The pair of shields in the fourth section are electrically connected either to crossover conductor 21 or to a section below 17 by means of electrical conductors 34 and 35. The capacitance for this embodiment is given by the expression:

$$C_n = C_x\left(\frac{n}{3} + 1.6a_k\left(\frac{4n^2 - 11n + 7}{n^2}\right)\right)$$

Although embodiments containing nonsequential windings which include either a single shield or a pair of shields within each section are disclosed, it is within the teachings of this invention to include as many shields as required to achieve the particular value of series capacitance desired for a particular transformer design.

Figure 6:
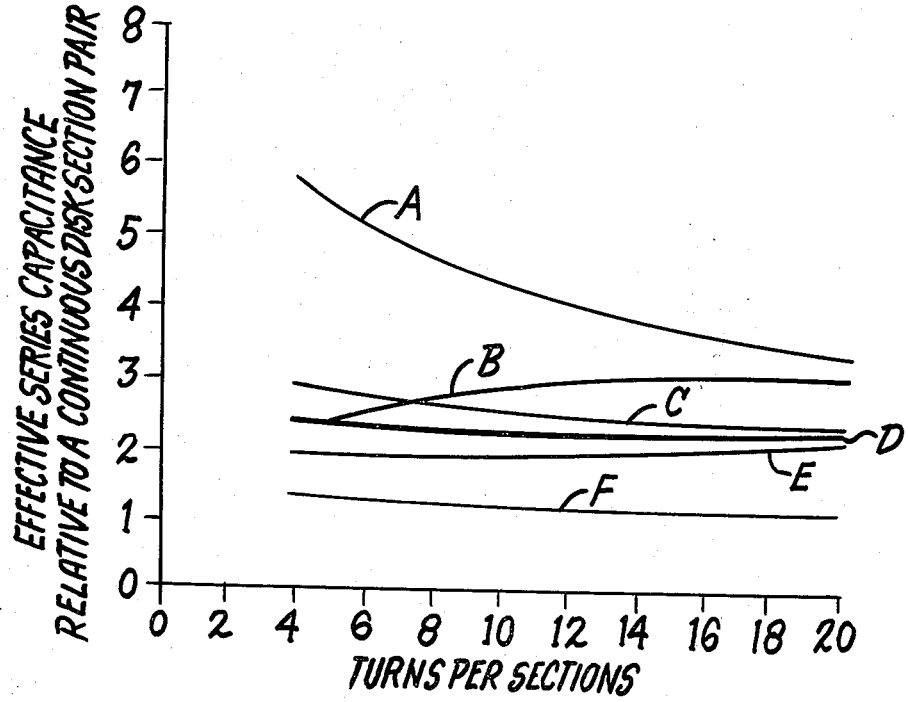
FIG. 6 is a graphic representation of the normalized effective series capacitance for various winding configurations.

The relationship between the effective series capacitance for various winding configurations as a function of the number of winding turns per section is given in FIG. 6. A nonsequential disk winding arrangement similar to FIG. 5 containing four shields on the outside of each winding section is shown at A. The series capacitance for an interlaced winding arrangement is shown at B for comparison purposes. It is to be noted that the normalized effective series capacitance for nonsequential disk winding arrangement A is very large for coils having a relatively few number of turns per section. The effective series capacitance for a nonsequential winding arrangement similar to FIG. 5 containing a single shield at the outside of each winding section is shown at C. A nonsequential winding arrangement having a single shield in the outer end as shown in FIG. 1 wherein one shield in the first section is electrically connected to one shield in the second section, and one shield in the third section is connected to a single shield in the fourth section, is shown at D. The normalized series capacitance for a nonsequential winding arrangement not containing any electrostatic shield is shown at E. The normalized effective series capacitance of a continuous winding arrangement containing one shield per section is shown at F for comparison purposes.

Figure 7:
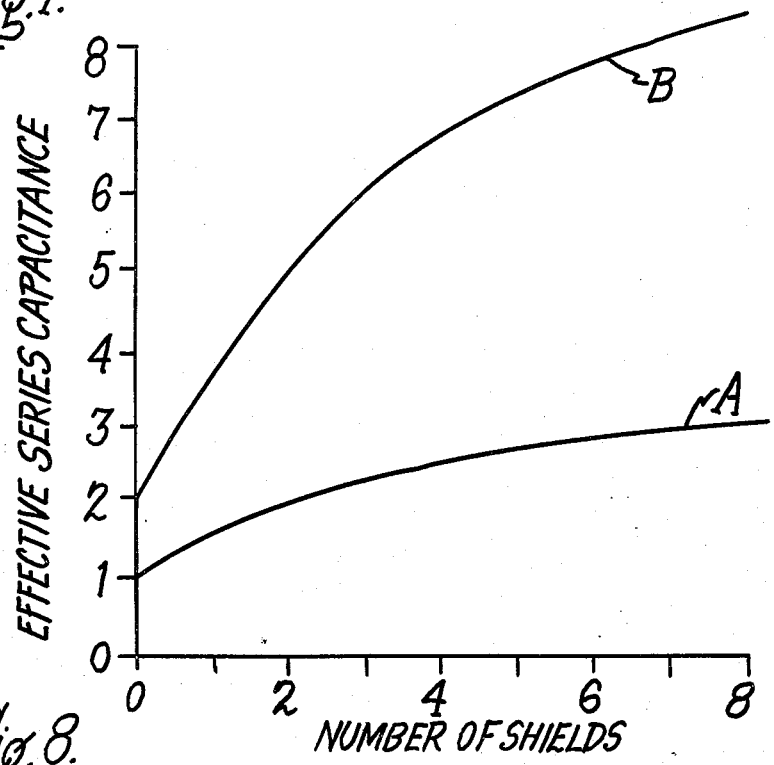
FIG. 7 is a graphic representation of the effective series capacitance as a function of the number of shields for various windings configurations.

The variation in the effective series capacitance as a function of the number of shields employed per winding section is shown in FIG. 7. Curve A is the effective series capacitance for a given section geometry as the number of shields per section is increased from zero (i.e. a plane continuous disk) to some integer value. Curve B is the effective series capacitance for a given section geometry wound as a nonsequential disk as the number of shields per section is increased from zero to some integer value. The nonsequential configuration used for obtaining the data in Table II is the embodiment shown in FIG. 5.

Figure 8:
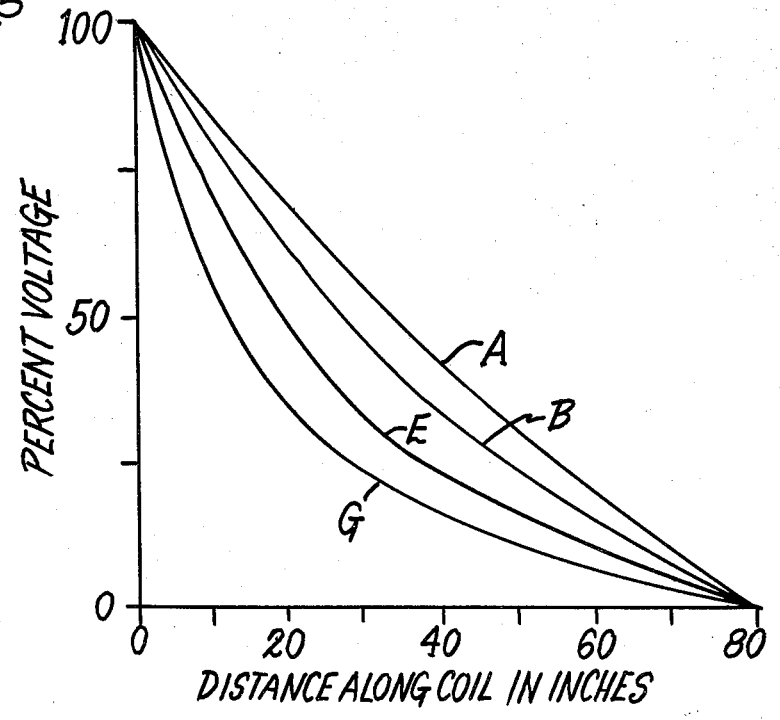
FIG. 8 is a graphic representation of the percent voltage variation as a function of distance along the coil for various winding configurations.

The initial voltage distribution after an impulse voltage is applied is shown for various winding configurations in FIG. 8. The greatest variation in percent voltage along the winding occurs at G which represents a continuous winding with one shield per section. The next greatest variation occurs at E which represents a nonsequential winding arrangement without electrostatic shields. The voltage variation for an interlaced winding arrangement is shown at B to be less distorted than either a continuous winding arrangement with a shield or a nonsequential winding without electrostatic shields. A more nearly linear distribution along the coil occurs at A for a nonsequential winding arrangement containing internal shields in accordance with the teachings of this invention.

Electrostatic shields within nonsequential disk windings are disclosed for power transformer operation. This is for purposes of example only since the inclusion of electrostatic shields within nonsequential winding arrangements finds application in any inductive device where high effective series capacitance is desired.

What is claimed as new and which it is desired to secure by Letters Patent of the United States is:

1. A disc coil winding arrangement for a transformer comprising:

a plurality of turns of insulated electrical conductors radially disposed around a winding form in a disc winding configuration;

a plurality of winding sections of said radially disposed conductors linearly arranged along said winding form;

an electrostatic ring shield adjacent one of said winding sections and electrically connected with another of said winding sections;

said winding sections being electrically interconnected in a nonsequential manner wherein a first one of said winding sections is electrically connected with a second one of said winding sections and a third one of said winding sections is electrically connected with a fourth one of said winding sections, said first and said fourth winding sections being electrically connected together, said second winding section being electrically connected to the electrostatic ring shield and said third winding section being adapted for connection to a terminal on the transformer;

at least one electrostatic shield within said first winding section electrically connected to the electrostatic ring shield;

at least one electrostatic shield within said second winding section electrically connected with at least one electrostatic shield in said third winding section; and an electrostatic shield in said fourth section adapted for connection with a terminal on the transformer.

2. The winding arrangement of claim 1 wherein the electrostatic shields in said first, second, third, and fourth winding sections are located proximate said winding form.

* * * * *